US007319836B2

(12) United States Patent
Kuroda

(10) Patent No.: US 7,319,836 B2
(45) Date of Patent: Jan. 15, 2008

(54) IMAGE FORMING DEVICE

(75) Inventor: Yoshiharu Kuroda, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 11/608,139

(22) Filed: Dec. 7, 2006

(65) Prior Publication Data

US 2007/0098444 A1 May 3, 2007

Related U.S. Application Data

(63) Continuation of application No. 11/033,235, filed on Jan. 11, 2005, now Pat. No. 7,173,409.

(30) Foreign Application Priority Data

Jan. 26, 2004 (JP) ..... 2004-016512
Nov. 10, 2004 (JP) ..... 2004-325866

(51) Int. Cl.
*G03G 15/00* (2006.01)

(52) U.S. Cl. ..... 399/167; 399/116

(58) Field of Classification Search ..... 399/167, 399/159, 116
See application file for complete search history.

(56) References Cited

U.S. PATENT DOCUMENTS

| | | | | |
|---|---|---|---|---|
| 4,829,335 | A * | 5/1989 | Kanemitsu et al. | 399/167 |
| 6,128,454 | A | 10/2000 | Kawai et al. | 399/116 |
| 7,173,409 | B2 * | 2/2007 | Kuroda | |
| 2001/0021320 | A1 | 9/2001 | Murayama et al. | 399/117 |
| 2003/0059233 | A1 | 3/2003 | Jang et al. | 399/167 |
| 2005/0089345 | A1 | 4/2005 | Yasumoto | 399/167 |

FOREIGN PATENT DOCUMENTS

| | | |
|---|---|---|
| JP | 08-115009 | 5/1996 |
| JP | 2002304030 A * | 10/2002 |

* cited by examiner

*Primary Examiner*—Susan Lee
(74) *Attorney, Agent, or Firm*—Hogan & Hartson LLP

(57) ABSTRACT

An image forming device includes a device frame and a photoconductive drum. The device frame includes a driving device, a driving gear that transmits a driving force from the driving device, and an urging member that supports the driving gear in a manner capable of moving along a moving direction of a photoconductive drum and urges the driving gear in an opposite direction from a direction in which the photoconductive drum is inserted. The photoconductive drum is inserted in the device frame and includes a driven gear to be engaged with the driving gear.

7 Claims, 3 Drawing Sheets

IMAGE FORMING DEVICE

RELATED APPLICATIONS

This is a continuation of application Ser. No. 11/033,235 filed on Jan. 11, 2005 now U.S. Pat. No. 7,173,409, which claims priority under 35 USC 119 in Japanese Patent Application Nos. 2004-016512, filed on Jan. 26, 2004 and 2004-325866 filed on Nov. 10, 2004, which applications are incorporated by reference in their entireties.

BACKGROUND OF THE INVENTION

1. Field of the Invention

The present invention relates to an electrophotographic image forming device. In particular, the present invention relates to an image forming device which can transmit a driving force by engaging a driving gear of a device frame and a driven gear of a photoconductive drum after inserting the photoconductive drum into the device frame.

2. Description of Related Art

In a conventional image forming device which forms an image by transferring a toner image onto paper, when a photoconductive drum is inserted into a device frame, a driven gear of the photoconductive drum is engaged with a driving gear which receives a driving force from a driving source of the device frame. In such a conventional image forming device, when the photoconductive drum is a unit and the photoconductive drum unit is inserted into the device frame, or when the photoconductive drum is inserted into the device frame, a driving force is transmitted from the driving source of the device frame to the photoconductive drum.

However, just by inserting the photoconductive drum unit or the photoconductive drum into the device frame, there are cases in which the driving gear and the driven gear are not engaged satisfactorily with one another. That is, there are cases in which a tooth of the driving gear of the device frame and a tooth of the driven gear of the photoconductive drum contact with one another (a tooth contact is generated) and a normal engaged state cannot be established.

However, according to the present invention, when the photoconductive drum is inserted into the device frame, even in case the tooth contact is generated, an engaged state of the gears can be normalized easily.

SUMMARY OF THE INVENTION

According to an aspect of the present invention, an image forming device includes a device frame and a photoconductive drum which is inserted into the device frame. The device frame includes a driving device, a driving gear for transmitting a driving force from the driving device and an urging member. The urging member supports the driving gear in a manner capable of moving along a moving direction of the photoconductive drum. The urging member urges the driving gear in an opposite direction from a direction in which the photoconductive drum is inserted.

According to an aspect of the present invention, when inserting the photoconductive drum into the device frame, in case a tooth of the driving gear and a tooth of the driven gear make contact with one another, the driving gear is preferable to be pushed in against the urging force of the urging member by continuing to insert the photoconductive drum into the device frame.

According to an aspect of the present invention, after the photoconductive drum is inserted into the device frame, it is preferable that the driving source is driven to rotate the driving gear slightly.

According to an aspect of the present invention, the driving device is preferable to be a motor fixed on a frame of the device frame. The driving gear is preferable to be mounted on an output shaft of the motor in a manner capable of sliding in an axial direction of the output shaft.

According to an aspect of the present invention, it is preferable that a key extending over approximately an entire length of the output shaft is fixed on the output shaft and the driving gear can be rotated with the output shaft by the key regardless of where the driving gear is located on the output shaft.

According to an aspect of the present invention, it is preferable that the urging member is a coil spring and wound around the output shaft between the driving gear and the frame.

According to an aspect of the present invention, it is preferable that a shaft hole is formed through the frame and under a state in which the photoconductive drum is inserted in the device frame, a shaft of the photoconductive drum is inserted through the shaft hole.

According to the present invention, the driving gear is provided movable in an axial direction via the urging member. Therefore, even when a tooth of the driven gear of the photoconductive drum and a tooth of the driving gear make contact with one another, the tooth contact does not influence the insertion of the photoconductive drum. When the photoconductive drum is inserted, in case both of the gears are not engaged with one another, just by rotating the driving gear slightly, the tooth contacting state is resolved and both of the gears are engaged with one another normally. As a result, a driving force can be transmitted preferably to the photoconductive drum.

DETAILED DESCRIPTION OF THE INVENTION

Figure 1:
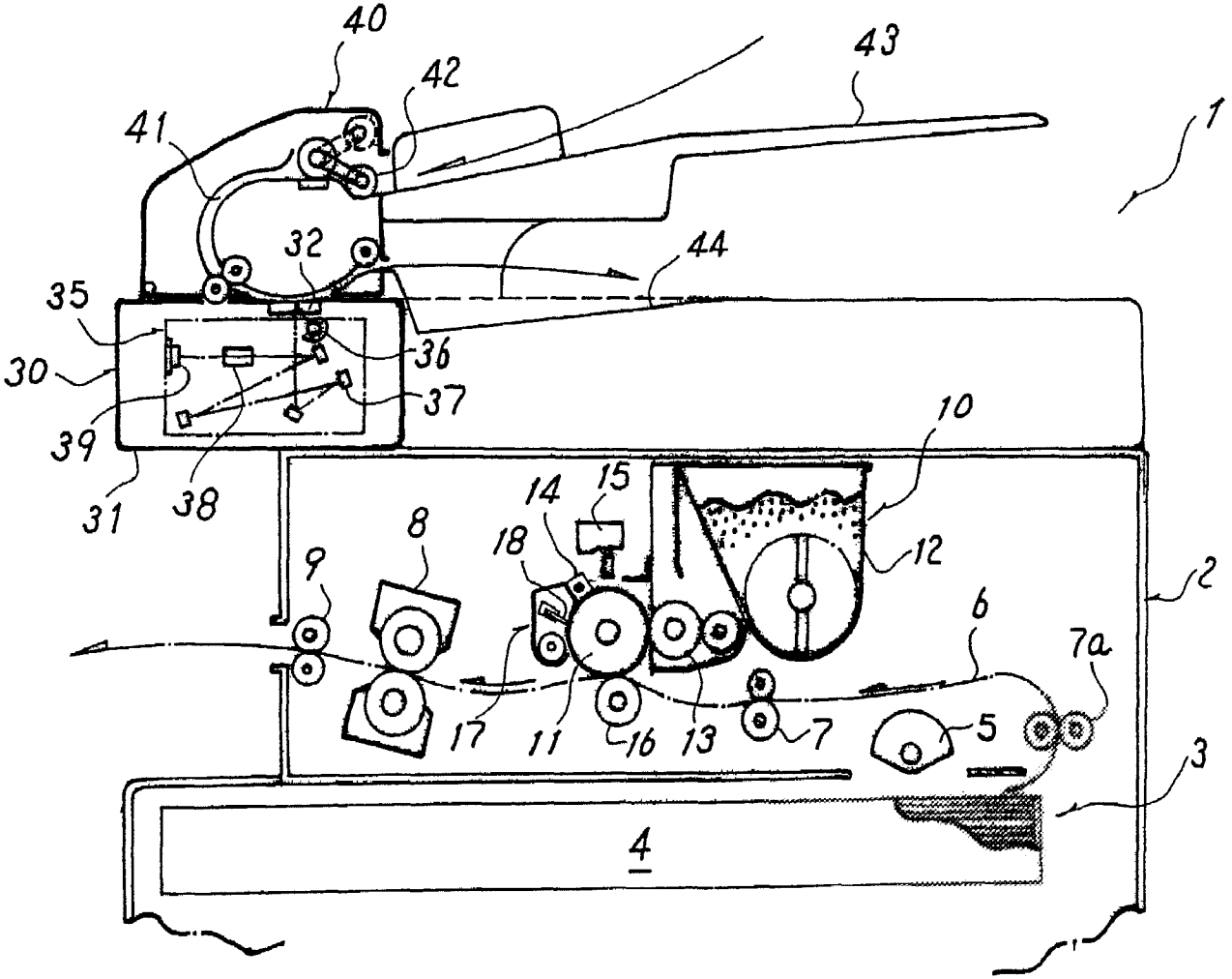
FIG. 1 shows an image forming device according to an embodiment of the present invention.

Embodiments of the present invention will be described. Further, the embodiments to be described below are preferable specific examples for implementing the present invention. Therefore, there are various technical limitations in the description. However, unless explicitly stated in the following description to limit the present invention, the present invention shall not be limited to the embodiments.

An image forming device 1 according to an embodiment of the present invention will be described. The image forming device 1 is an electrophotographic image forming device which transfers and fixes a toner image onto paper.

The image forming device 1 can be applied to a facsimile machine, a printer device, a copying machine or a Multi Function Peripheral (MFP) having multiple functions of these machines. The image forming device 1 includes a printing unit 10 provided in a device frame 2. The printing unit 10 prints an image onto the paper by using an electrophotographic method. An image scanning device 30 and an Automatic Document Feeder (ADF) 40 are provided in an upper part of the device frame 2. In the embodiment to be described below, the structure of the image scanning device 20 is omitted. Therefore, a drive transmitting mechanism to a photoconductive drum 11 inserted in the device frame 2 will be described mainly.

In the image forming device 1 shown in FIG. 1, at least one paper feed cassette 4 is provided in a paper feed unit 3 provided in a lower part of the device frame 2. The paper is fed from the paper feed cassette 4 by a paper feed roller 5. The fed paper is fed into a paper transportation path 6 and transported toward the printing unit 10. Further, a plurality of paper feed cassettes 4 can be set in the paper feed unit 3. A paper feed cassette 4 storing paper of a necessary size can be selected. Then, the paper can be fed from the selected paper feed cassette 4. A plurality of transportation roller devices 7 and 7*a* are disposed along the paper transportation path 6 with a prescribed interval between one another.

A leading edge of the paper fed from the paper feed cassette 4 hits against the transportation roller device 7 upstream of the printing unit 10 in the paper transportation path 6. Under this state, an additional feeding force is applied to the paper by the transportation roller device 7*a* located further upstream in the paper transportation path 6 and the paper is looped. When the leading edge of the paper enters into a nip of the transportation roller device 7, the leading edge of the paper is arranged and the paper stops under this state. The transportation roller device 7 is driven in accordance with a timing in which a toner image is formed on the photoconductive drum 11. The paper is transported toward a nipped part between the photoconductive drum 11 and a transfer roller 16. Under a state in which the paper is nipped between the photoconductive drum 11 and the transfer roller 16, when a transfer voltage is impressed to the transfer roller 16, the toner image is transferred onto the paper.

The printing unit 10 includes the photoconductive drum 11 like a general electrophotographic device. A charging member 14, a writing member 15, a developing device 12, the transfer roller 16 and a cleaning device 17 are disposed around the photoconductive drum 11 along a rotational direction of the photoconductive drum 11. The developing device 12 is provided downstream of the writing member 14. A developing roller 13 exposed to an outer side of the printing unit 10 makes contact with the photoconductive drum 11. A surface of the photoconductive drum 11 is charged uniformly by the charging member 14. By irradiating a light of an image by the writing member 15, an electrostatic latent image is formed on the surface of the photoconductive drum 11. A toner is supplied from the developing roller 13 and adhered onto the electrostatic latent image. Accordingly, a toner image as a visible image is formed.

As described above, when the paper is transported while being nipped between the photoconductive drum 11 and the transfer roller 16, the toner image is transferred onto the paper by the transfer roller 16 to which a voltage of a prescribed value is impressed. When the paper passes a fixing device 8, heat and pressure are applied to the toner image carried on the paper and the toner image is fixed onto the paper. Then, the paper is discharged onto a discharge tray (not shown) by a discharge roller device 9. After transferring the toner image formed on the photoconductive drum 11 onto the paper, the toner remaining on the photoconductive drum 11 without being transferred is scraped off by a blade 18 of the cleaning device 17. The scraped off toner is transported toward a waste toner box (not shown).

In the above-described image forming device 1, in a small-sized printer or the like, the photoconductive drum 11 provided at the printing unit 10 is designed capable of carrying out an image forming process for approximately several thousands sheets. Therefore, when a number of printed sheets exceeds a designated number of sheets, a message indicating a replacement of the photoconductive drum 11 is displayed on a display unit (not shown). There are cases in which the photoconductive drum 11 is replaced solely and cases in which the photoconductive drum 11 is replaced as a photoconductive drum unit including a peripheral member. In the present invention, the photoconductive drum 11 can be replaced solely or as a photoconductive drum unit. In the image forming device 1 of the present embodiment, when the photoconductive drum 11 is inserted in the device frame 2, a driving gear 24 of a driving mechanism of the device frame 2 engages with a drum gear 25 as a driven gear of the photoconductive drum 11.

Figure 2:
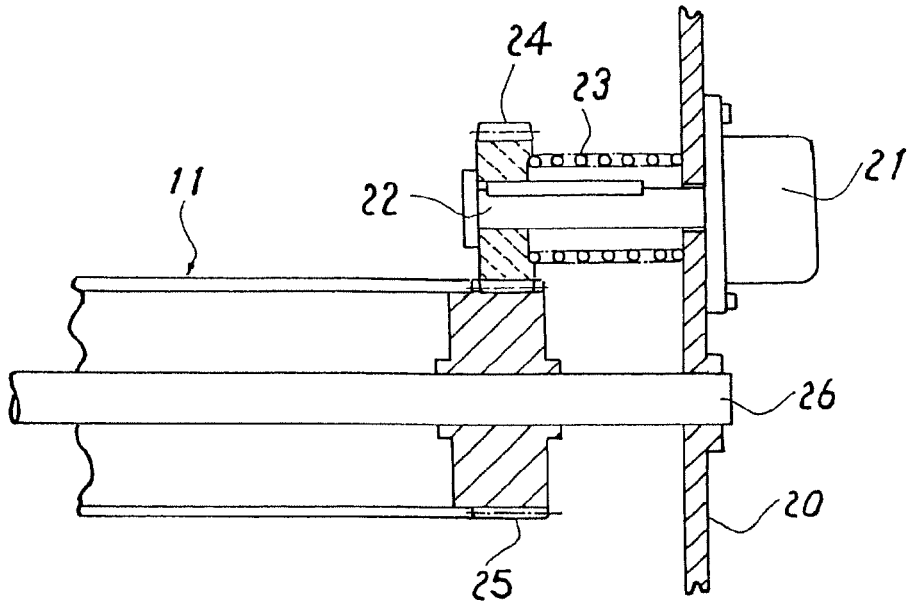
FIG. 2 shows a state in which a driven gear of a photoconductive drum and a driving gear of a device frame are engaged normally with one another.

As shown in FIG. 2, a driving device 21 of the device frame 2 is provided. The drum gear 25 of the photoconductive drum 11 inserted in the device frame 2 engages with the driving gear 24 of the driving device 21. To describe in detail, the driving device 21 shown in FIG. 2 is fixed on a frame 20 of the device frame 2. The driving device 21 includes a motor having a deceleration mechanism. A tip end of an output shaft 22 of the motor is protruding inward in the printing unit 10. The driving gear 24 is mounted on the tip end of the output shaft 22. The driving gear 24 is capable of sliding along the output shaft 22. The driving gear 24 is urged at all times toward a tip end of the output shaft 22 by a spring 23 as an urging member. The spring 23 is wound around the output shaft 22 between the driving gear 24 and the frame 20. A key extending over an entire length in an axial direction of the output shaft 22 is fixed on the output shaft 22. Therefore, regardless of where the driving gear 24 is located on the output shaft 22 in the axial direction of the output shaft 22, the driving gear 24 can be rotated by the output shaft 22. Furthermore, the drum gear 25 is fixed at a position displaced from an image forming region on the photoconductive drum 11. Further, in the example shown in the drawing, under a state in which the photoconductive drum 11 is inserted in the device frame 2, a tip end of a drum shaft 26 of the photoconductive drum 11 is inserted in a shaft hole of the frame 20 and the photoconductive drum 11 is positioned with respect to the device frame 2.

Figure 3:
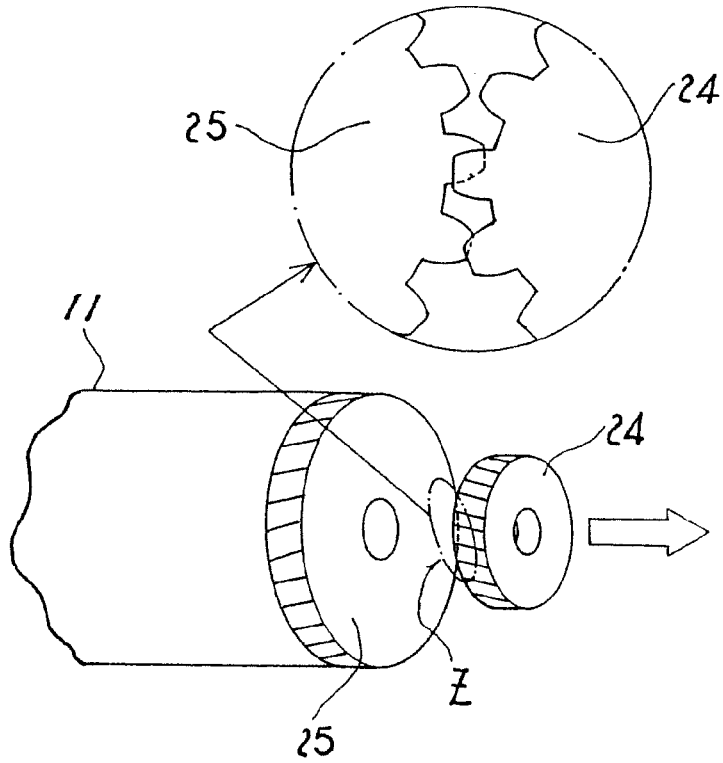
FIG. 3 is a perspective view showing a state in which a tooth of the driven gear of the photoconductive drum and a tooth of the driving gear of the device frame are making contact with one another.

When inserting the photoconductive drum 11 into the device frame 2 for replacing or reinserting the photoconductive drum 11, if the photoconductive drum 11 is simply pushed in along the drum shaft 26, there are cases in which a tooth of the driving gear 24 and a tooth of the drum gear 25 contact with one another and a preferable engaged state cannot established. That is, as shown in FIG. 3, a failure is prone to generate such that the gear teeth contact (collide) with one another at a tooth contacting part Z. If the driving gear 24 is fixed on the output shaft 22, the drum gear 25 forcibly pushes the driving gear 24. In this case, when inserting the photoconductive drum 11, if the photoconductive drum 11 is not rotated at a prescribed angle at the same time as when pushing in the photoconductive drum 11, the photoconductive drum 11 may not be inserted preferably.

Figure 4:
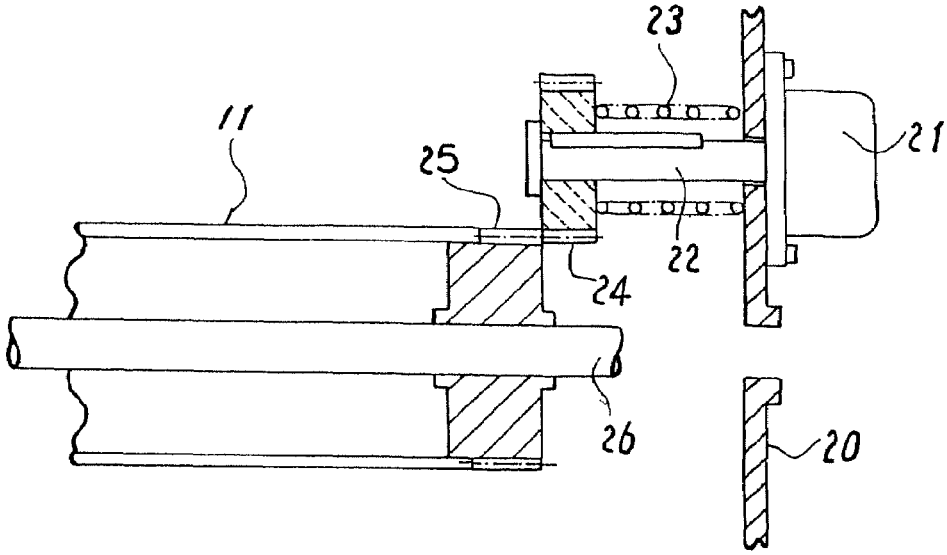
FIG. 4 is a cross-sectional view of FIG. 3.
Figure 5:
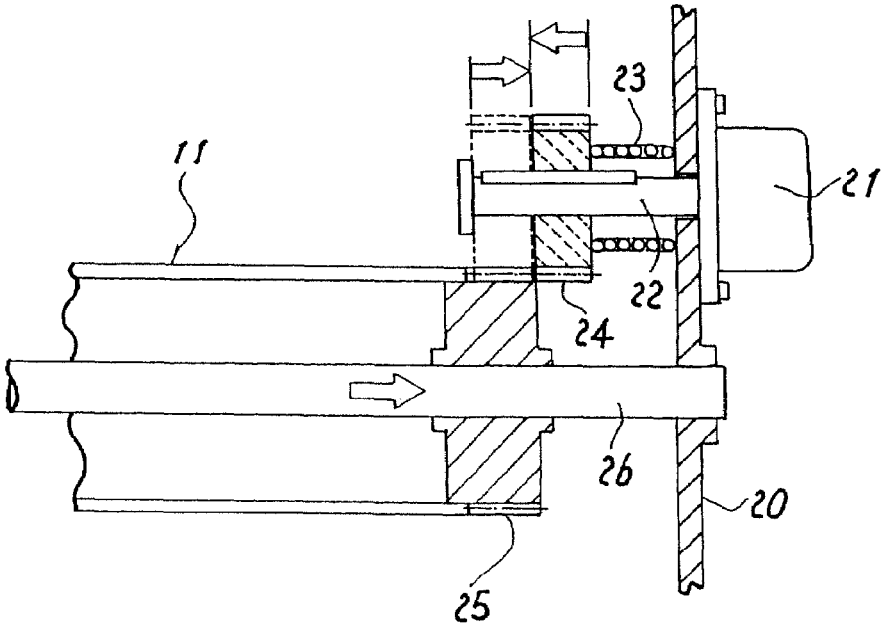
FIG. 5 shows a movement when inserting the photoconductive drum into the device frame.

To solve the drawback of the above-described tooth contact of the gears, as shown in FIG. 2, in the image forming device 1 of the present embodiment, the driving gear 24 of the device frame 2 is provided movable with respect to the axial direction of the output shaft 22 and urged by the spring 23 from a rear side of the driving gear 24. Therefore, when inserting the photoconductive drum 11 into the printing unit 10, as shown in FIG. 4, the driving gear 24 and the drum gear 25 collide with one another at the teeth contacting part Z. However, when the photoconductive drum 11 is pushed further against the urging force of the spring 23, as shown in FIG. 5, the driving gear 24 is pushed and recedes to a position shown with a solid line in the drawing. The photoconductive drum 11 is maintained at a prescribed operation position under a state in which the gear teeth are contacting with one another. Under this state, since the drum gear 25 is not engaged normally with the driving gear 24, the photoconductive drum 11 cannot rotate normally.

However, in the image forming device 1 of the present embodiment, under the state shown with the solid line in FIG. 5, by driving the driving device 21 and slightly rotating the output shaft 22, the state in which the gear teeth are pushing one another is resolved. That is, when the output shaft 22 rotates slightly and the driving gear 24 and the drum gear 25 are located at a position to be engaged with one another, the driving gear 24 moves toward the drum gear 25 by the urging force of the spring 23. When the driving gear 24 moves from the solid line position of FIG. 5 to an imaginary line position, the driving gear 24 and the drum gear 25 are engaged completely with one another. Accordingly, the photoconductive drum 11 can be driven by the driving device 21.

As described above, a process for driving the driving device 21 for a short period of time after setting the photoconductive drum 11 at the printing unit 10 is preferable to be provided in an initializing step of the image forming device 1. The initializing step is a step for confirming whether or not each of the members of the printing unit 10 is operating normally. That is, in a general image forming device, after the photoconductive drum 11 is replaced or after each of the members of the printing unit 10 is reequipped, in accordance with a control program set in a control device of the image forming device 1, the photoconductive drum 11 idles just for a short period of time and a confirmation is carried out in an initializing operation for confirming that each of the members is operating normally. Therefore, by using the above-described operation, the engagement of the gear teeth can be normalized. Thus, the photoconductive drum 11 can be inserted easily compared with a conventional image forming device.

The image scanning device 30 provided in the upper part of the device frame 2 will be described briefly As shown in FIG. 1, a scanner device 35 which scans an image of an original document in cooperation with the ADF 40 is provided at a fixed position on an upper frame 31. As shown in the drawing, the scanner device 35 includes a plurality of mirrors 37, a lens 38 and a Charge Coupled Device (CCD) 39 as one unit. The scanner device 35 is fixed at a position corresponding to a platen 32 in proximity to an end part of the upper frame 31. In the scanner device 35, a light from a lamp 36 is irradiated on the original document moving while sliding an image surface against the platen 32. The reflected light is reflected by the plurality of mirrors 37. The reflected light is focused by the lens 38 and an image is formed in the CCD 39. Optical information corresponding to the original document is obtained as digital information.

The ADF 40 includes a document tray 43 and a discharge tray 44 provided one on the other vertically with a prescribed interval between one another. The trays 43 and 44 are fixed on the upper frame 31. The ADF 40 includes a document transportation path 41 which connects the two trays 43 and 44. The document transportation path 41 is formed in approximately a sideways letter-U shape like a conventional ADF. The platen 32 is provided at a lower part of a curved part of the document transportation path 41. While the original document picked up by a document feeder 42 one sheet at a time is transported through the document transportation path 41 at a constant speed, an image scanning process is carried out.

By combining the device frame 2 having the printing unit 10 and the image scanning device 30 provided in the upper part of the device frame 2, a MFP having functions of a copying machine and a facsimile machine can be formed. Without providing the image scanning device in the upper part of the device frame 2, the device frame 2 can be used as a printer. The image scanning device provided in the upper part of the device frame 2 can be formed as a mechanism which supports both a Flat Bed Scanner (FBS) function and an ADF function.

The invention claimed is:

1. An image forming device comprising:

a device frame which includes:

a driving device, and a driving gear that transmits a driving force from the device; and a photoconductive drum which is inserted in the device frame and includes a driven gear to be engaged with the driving gear, wherein after the photoconductive drum is inserted in the device frame, by driving the driving device and slightly rotating the driving gear, the driving gear engages with the driven gear, and wherein the driving gear is slightly rotated at an initializing step of the image forming device.

2. The image forming device according to claim 1, wherein the driving gear is movable along a moving direction of the photoconductive drum, and the device frame includes an urging member that urges the driving gear in an opposite direction from a direction in which the photoconductive drum is inserted.

3. The image forming device according to claim 2, wherein when inserting the photoconductive drum into the device frame, in case a tooth of the driving gear and a tooth of the driven gear contact with one another, by inserting the photoconductive drum further into the device frame, the driving gear is pushed in against an urging force of the urging member.

4. The image forming device according to claim 2, wherein the driving device is a motor fixed on a frame of the device frame, and the driving gear is mounted on an output shaft of the motor in a manner capable of sliding in an axial direction of the output shaft.

5. The image forming device according to claim 4, wherein a key extending over approximately an entire length of the output shaft is fixed on the output shaft, and the driving gear can rotate with the output shaft by the key regardless of where the driving gear is located on the output shaft.

6. The image forming device according to claim 4, wherein the urging member is a coil spring and would around the output shaft between the driving gear and the frame.

7. The image forming device according to claim 4, wherein a shaft hole is formed through the frame, and under a state in which the photoconductive drum is inserted in the device frame, a shaft of the photoconductive drum is inserted through the shaft hole.

* * * * *